US005619745A

United States Patent [19]

Kobayashi

[11] Patent Number: 5,619,745

[45] Date of Patent: Apr. 8, 1997

[54] PROCESSING APPARATUS FOR A SILVER HALIDE LIGHT-SENSITIVE MATERIAL

[75] Inventor: Hiroaki Kobayashi, Hino, Japan

[73] Assignee: Konica Corporation, Tokyo, Japan

[21] Appl. No.: 632,721

[22] Filed: Apr. 10, 1996

[30] Foreign Application Priority Data

Apr. 17, 1995 [JP] Japan ..... 7-090813

[51] Int. Cl.[6] ..... G03D 3/02; G03D 13/00

[52] U.S. Cl. ..... 396/626; 396/572; 396/630; 396/631

[58] Field of Search ..... 396/572, 571, 396/577, 626, 630, 631

[56] References Cited

FOREIGN PATENT DOCUMENTS

0452940A3 10/1991 European Pat. Off. .

OTHER PUBLICATIONS

Patent Abstracts Of Japan, vol. 95, No. 6, of JP–A–07 056309 (1995).

Patent Abstracts Of Japan, vol. 2, No. 62 (E–032) of JP–A–53 028426 (1978).

Patent Abstracts Of Japan, vol. 8, No. 237 (P–310) of JP–A–59 111646 (1984).

Patent Abstracts Of Japan, vol. 95, No. 1, of JP–A–06 282049 (1994).

Patent Abstracts Of Japan, vol. 18, No. 96 (P–1694) of JP–A–05 297549 (1993).

*Primary Examiner*—D. Rutledge

*Attorney, Agent, or Firm*—Frishauf, Holtz, Goodman, Langer & Chick, P.C.

[57] ABSTRACT

In an apparatus for processing a light-sensitive material, a plurality of processing tanks are serially arranged along a conveyance passage on which the light-sensitive material is conveyed in a conveying direction. The apparatus comprises a device for replenishing compensation water into a most-downstream tank arranged most downstream among the plurality of processing tanks in terms of the conveying direction under the following inequality:

$$0 \leqq (E-C)/(P-R) < 0.3$$

E (ml/day): amount of evaporated water from the plurality of processing tanks per day, C (ml/day): amount of the compensation water to compensate the evaporated water, P ($m^1$/day): amount of the light-sensitive material processed per day, R (ml/$m^2$): amount of replenishing processing solution per $m^2$ of light-sensitive material.

9 Claims, 6 Drawing Sheets

PROCESSING APPARATUS FOR A SILVER HALIDE LIGHT-SENSITIVE MATERIAL

BACKGROUND OF THE INVENTION

The present invention relates to an automatic processing machine and a processing method for a silver halide light-sensitive material, and particularly to a supplying method and a supplying amount of evaporation compensation water in an automatic processing machine and a processing method for a color light-sensitive material.

Heretofore, a silver halide light-sensitive material has been subjected to photographic processing through the steps of developing, desilvering, washing and stabilizing, after exposure. Processing is ordinarily conducted by the use of an automatic processing machine (hereunder, it may be abbreviated as "automatic machine"). In this occasion, there has been adopted a system wherein the degree of the activity of a processing solution inside a processing tank is so controlled as to be kept constant by the use of replenisher water. Functions of the replenishing solution include dilution of substances dissolved from the light-sensitive material, replenishing of consumed components in the processing solution and compensation of evaporated water. In the above-mentioned system, since solutions are supplied, plastic bottles are frequently employed, and, ordinarily, a large amount of overflow was ejected.

However, recently, regulations on effluent and plastic materials disposal have become strict on a worldwide basis. Therefore, there has been demand for development of a system wherein effluent from such automatic machines is reduced to zero and the use of a plastic bottle for a liquid agent is eliminated.

In the proliferating mini-labs, in order to reduce cost and overcome labor shortage, it has been advanced to employ part-time workers who have no specialized knowledge. Also, since daily processing amount is relatively small, for example, the processing amount is 5 pieces of color roll film per day as an average over a week and machines are downsized, influence from the fatigue of the processing solution through the passage of time and an amount of the evaporated water relatively become large.

In order to cope with the above-mentioned circumstance changes, it is necessary to design a system wherein the amount of effluent from the automatic machine is reduced to substantially zero or close to zero, it is more stable than ever and maintenance is easier. Specifically, in order to reduce the amount of effluent from the automatic machine substantially, it is necessary to reduce the density of chemicals in the processing solution. However, currently, measures for making a stable system while reducing the density of the processing chemicals has not yet been discovered.

SUMMARY OF THE INVENTION

An object of the present invention is to overcome the above-mentioned shortcomings. Practically, it is to develop a stable automatic machine system wherein the amount of replenishing solution is small, and thereby, the amount of effluent is also small, the mechanism of the machine is simple and maintenance is easy, even though processing solutions of low chemical density is used. In addition, it is to develop a processing method wherein influence from entering of the processing solution from a preceding step is negligible and there is neither stain nor contamination on the reverse side of the light-sensitive material processed, though the replenishing amount for the automatic machine is low.

The above-mentioned objects are attained by adopting the following structure.

Namely, the objects are attained by an automatic processing machine for light-sensitive material wherein, when aforesaid machine is equipped with a series of processing tanks with the circulation of the processing solution and compensation water is supplied based on the evaporation of water, the compensation water is supplied to the final-process tank collectively and the amount of compensation water is within the range of the following inequality, and by a processing method employing the same.

$0<$(amount of evaporated water E–amount of compensation water C)/(amount of processed light-sensitive material×replenished amount R)$<0.4$ amount of evaporated water: amount of evaporated water from a series of processing tanks per day (ml/day), wherein the amount of evaporated water is total amount of amount of evaporated water from the series of tanks when the temperature control is conducted for 10 hours under the ambient condition that temperature is 25° C. and relative humidity is 50% and amount of evaporated water when the temperature control is not conducted for 14 hours under the above ambient condition, amount of compensation water: amount of compensation water supplied per day (ml/day)

amount of light-sensitive material processed: amount of light-sensitive material processed per day ($m^2$/day), wherein the term "amount per day" means literally amount per day, however, instead, "amount per day" may means amount per day as an average over a week, replenished amount: amount of processing solution supplied for light-sensitive material of 1 $m^2$.

Incidentally, when the solid agent is directly supplied into the processing tank, the replenished amount is the sum of an amount of the solid agent and water replenished respectively for the light-sensitive material of 1 $m^2$.

Due to the above-mentioned structure, with regard to a series of processing tanks wherein the processing solution is circulated, it is not necessary to provide a device for supplying compensation water to each tank. Therefore, the mechanism of the automatic machine becomes simpler accordingly. This results in not only cost reduction and easier maintenance but also greatly reducing the carrying-over density from each preceding processing tank to the final-process tank (this applies, for example, when a stabilizing tank has several partitions, the carry-over density of the fixing agent to the final-process tank can be reduced to extremely low). When the above-mentioned system is adopted, it is desirable that the automatic machine has a counter current mechanism. Incidentally, "a series of processing tanks wherein the processing solution is circulated" refers to plural tanks equipped with a specific mechanism which moves solution within individual tanks. Different kinds of processing tanks such as a fixing tank and a stabilizing tank are acceptable.

The structure to shift the solution may be a structure to flow the solution by utilizing the level difference between the tanks or a structure to suck the solution from a tank and to deliver the solution to the other tank by using a pump such as a bellows pump.

"The final-process tank" is defined as the final tank of a series of processing tanks.

As a technology related to the structure of the present invention, there are several technologies such as Japanese Patent Publication Open to Public Inspection (hereinafter, referred to as Japanese Patent O.P.I. Publication) No. 56309/

1995 which has a structure to feed compensation water to the final-process tank collectively and Japanese Patent O.P.I. Publication No. 1756/1992 which presents a method to add a predetermined amount of compensation water by estimating the amount of evaporation water in advance. However, it was not known that the combination of the above-mentioned technologies is beneficial in terms of the cost performance and downsizing of the automatic machine.

When conducting continuous processing by means of the above-mentioned combination, it is easily influenced from the entering of the processing solution from the preceding process, frequently causing staining and deterioration in terms of storage stability of the processing solution, because reduction of the replenishing amount of processing agents has now been advanced due to concerns of pollution. The degree of the above-mentioned influence is acceleratedly increased when the amount of processing per day is little. In addition, it was found that there was a tendency that the density of the processing solution becomes too low. If the density of the processing solution is reduced than the standard contrary to estimation, the performance is deteriorated rapidly because the replenishing amount of the processing solution was lowered originally. As a result, expected performance cannot be maintained.

Further, in a conventional method in which a given amount of evaporation compensation water is supplied when a low level of the processing solution lowering to a predetermined low level is detected by a level sensor, since the replenishing of the solution is conducted independently, it may be difficult to detect the low level, the case that the compensation water is hardly replenished may be occurred. Accordingly, a liquid composition may be more highly concentrated, resulting in the abnormal concentration.

To counter these problems, the present inventor found that the amount of evaporated water, the amount of compensation water, the amount of processed light-sensitive material and the amount of replenished processing solution for the amount of processed light-sensitive material are within a certain range and conceived the structure of the invention.

Incidentally, (amount of evaporated water–amount of correction water)/(amount of light-sensitive material processed×replenished amount) may be referred to as "coefficient k". This k is preferable to satisfy the following formula: $0<k<3$.

The present invention can be applied to various silver halide light-sensitive materials, and specifically to a color light-sensitive material, such as color negative film and color photographic paper.

Preferable processing of the processing method of a color light-sensitive material of the present invention will be described as follows.

(1) Color developing→bleaching→fixing→washing
(2) Color developing→bleaching→fixing→washing→stabilizing
(3) Color developing→bleaching→fixing→stabilizing
(4) Color developing→bleaching→fixing→first stabilizing→second stabilizing
(5) Color developing→bleaching→bleach-fixing→washing
(6) Color developing→bleaching→bleach-fixing→washing→stabilizing
(7) Color developing→bleaching→bleach-fixing→stabilizing
(8) Color developing→bleaching→bleach-fixing→first stabilizing→second stabilizing
(9) Color developing→bleaching→bleach-fixing→fixing→washing→stabilizing
(10) Color developing→bleaching→bleach-fixing→fixing→first stabilizing→second stabilizing
(11) Color developing→bleaching→bleach-fixing→washing
(12) Color developing→bleaching→bleach-fixing→stabilizing In the present invention, "processing solution" is defined to be a solution with which the light-sensitive material comes in contact when the light-sensitive material is subjected to photographic processing. Practically, it includes a color developing solution, a black-and-white developing solution, a bleaching solution, a bleach-fixing solution, a fixing solution, a stabilizing solution, a reversing solution, a hardening solution, a conditioner and water used for washing the light-sensitive material (tap water, an ion-exchanged water and a solution to which an anti-mildew agent is added).

Typical developing solutions used in the present invention are, in the case of color developing, those which contain each paraphenylenediamine-based developing agent. To these, ordinarily, a pH regulator and a preserver are added. The processing solution to which the structure of the present invention with regard to the correction water is highly applicable is a stabilizing solution which is frequently divided into plural tanks.

Next, a stabilizing tank used in the present invention will be explained. The stabilizing solution of the present invention may employ a stabilizing replenishing solution. In addition, a method to replenish a solid processing agent directly into a processing tank, to which replenisher water is added may be accepted.

In the case of using the replenishing solution containing the processing agent, the concentration of the agent tends to become high at the time right after the replenishing solution is supplied, resulting in the fluctuation in the concentration of the agent. In contrast, in the case of using the replenishing solid agent, since the fluctuation in the concentration of the agent may be very little, it may be preferable to use the solid agent as the replenisher.

The number of washing tanks and stabilizing tanks may be one, each or may also be up to 10 each. When the number of tanks is increased, the replenishing amount of stabilizing solution in each tank can be reduced. However, from the viewpoint of downsizing of the automatic developing machine, 2 through 6 tanks are preferable.

When a stabilizing solution and a solid stabilizing replenishing agent are used, the replenishing tablet and replenisher water may be replenished at several points. However, it is preferable to adopt a so-called counter current system (a multi-step counter system) wherein replenishment occurs at the downstream tank in the processing flow of the light-sensitive material. A cascade type system is included in this system as one of them. The present invention is more preferable when there are two or more stabilizing tanks, and to the end of aforesaid stabilizing tank, a stabilizing replenishing agent, more preferably a solid stabilizing replenishing agent and replenisher water are replenished so that the overflow solution is carried into the preceding tank.

In the present invention, the number of fixing tanks or bleach-fixing tanks may be one or more. When there are a plurality of fixing tanks or bleach-fixing tanks, it is preferable that the replenishing processing agent is replenished into the end tank so that the overflow solution enters the preceding tank. In addition, the solution in the bleach-fixing tank may be constituted by a mixed solution of overflow from the bleaching tank and overflow from the fixing tank.

In such situations, it is preferable that tanks are arranged in the order of bleaching tank—bleach-fixing tank—and fixing tank.

In the present invention, it is necessary to pump up processing solutions from the washing tank or the stabilizing tank directly by means of a pump so as to feed them to the fixing tank or the bleach-fixing tank. It is preferable that the washing tank or the stabilizing tank is arranged directly after the fixing tank or the bleach-fixing tank so that the processing solution is transferred from the leading tank among aforesaid washing tanks or the stabilizing tanks so as to transfer the processing solution to the fixing tank or the bleach-fixing tank.

It is more preferable that a processing solution transferred from the above-mentioned washing tank or stabilizing tank is introduced to the aftermost tank among the fixing tanks or the bleach-fixing tanks. The most preferable case is when a liquid or solid fixing or bleach-fixing agent is replenished to a tank to which aforesaid processing solution is introduced.

"Pump" used in the present invention is referred to as a so-called solution-feeding pump. Practically, a diaphragm quantitative pump, a perister pump, an electromagnetic quantitative pump, an air driving bellows pump, a bellows pump, a quantitative pump, a tube pump, a syringe pump, a rotary pump, a gear pump, a vane pump, a hose pump, a plunger pump, a magnet pump, a spiral mottle pump, a liquid feeding pump, a rotary liquid pump, a peristaltic pump, a roller pump, a chemical handy pump a tubing pump, a magnet gear pump and a chemical handy pump are cited. Of these, from a viewpoint of quantitative feeding and a compact type, the bellows pump (for example, the bellows pump KB series and KBM series produced by Iwaki Co., Ltd.), the perister pump (SJ series produced by Atoh Co., Ltd.) and the electromagnetic quantitative pump (for example, EX series and EX-E series produced by Kobayashi Rika Co., Ltd. and Daiichi Kagaku Co., Ltd.) are preferably used.

To the bleaching solution and the bleach-fixing solution used in the present invention, ferric salt of each organic compound may be added as an oxidizing agent.

When a ferric complex of aminopolycarboxylic acid is used, it is preferable to be used in the form of an iron complex of the free acid of the aminopolycarboxylic acid. It is more preferable to be used in combination with the above-mentioned ferric complex and the free acid of the aminopolycarboxylic acid. It is, however, most preferable to use it in combination with the above-mentioned ferric complex and the free acid of the same aminopolycarboxylic acid compared to that which constitutes aforesaid ferric complex. In addition, a hydrate salt of aminopolycarboxylic acid may be used as a potassium salt, a sodium salt and an ammonium salt. The free acid of the aminopolycarboxylic acid can be used as a free acid, the potassium salt or the sodium salt.

The fixing processing agent of the present invention contains a thiosulfate. As a thiosulfate, an ammonium thiosulfate, a potassium thiosulfate and a sodium thiosulfate are cited. In the present invention, it is preferable that the sodium thiosulfate contained in the total amount of thiosulfate be 2 to 70 weight %, and it is more preferable that the sodium thiosulfate contained in the total amount of thiosulfate be 5 to 20 weight %.

The solid processing agent for fixing can contain, in addition to thiosulfate, conventional components which constitute the fixing agent such as sulfite, bisulfite, the addition products of sulfite, mesoion compounds, thioether compounds, chelating agents, nonionic or anionic surfactants and buffer agents. The solid processing agent for bleach-fixing agent can contain, in addition to the above-mentioned fixing agent constituting components, conventional bleaching components and fixing components such as halogenated compounds, conventional ferric salts of organic acids containing ferric salt of aminopolycarboxylic acid, solid organic acids, anti-mildew agents and anti-rust agents.

In addition, the solid processing agent of the present invention can further enhance inhibiting effect of the decomposition of thiosulfate over passage of time and to prevent the occurrence of powdering of the solid processing agent due to friction overtime by incorporating at least one kind of compound selected from polyethylene glycols, polyvinyl pyrrolidones, polyvinyl alcohols and sugars.

It is specifically preferable to add a fixing accelerator represented by the following Formula to the above-mentioned fixing solution and bleach-fixing solution. Even when the density of processing agent is reduced as much as possible as in recently, defective fixing does not result and any problem is not caused even when the processing agent is mixed into the stabilizing solution. Therefore, the effects of the present invention become more prominent.

Formula [1]

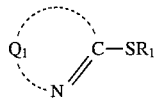

wherein $Q_1$ represents an atom group necessary to form a nitrogen-containing heterocycle (including those wherein a 5-to 6-membered unsaturated ring is condensed); $R_1$ represents a hydrogen atom, an alkaline metal atom,

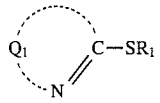

or an alkyl group; and Q' is defined as being identical to $Q_1$.

Next, practical examples of the compounds are exhibited.

(1)

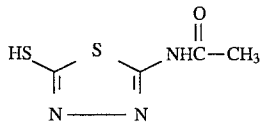

(2)

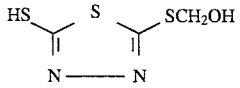

(3)

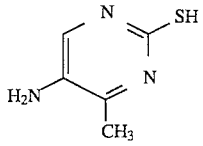

(4)

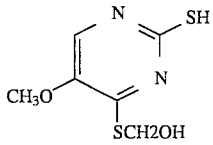

(5)

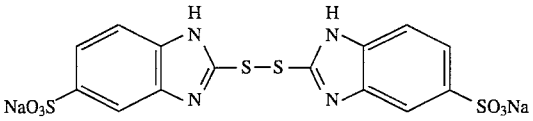

-continued
(6)
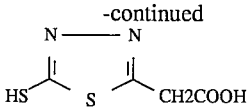
(7)
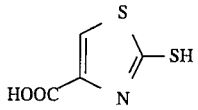
(8)
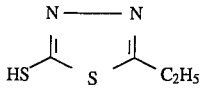
(9)
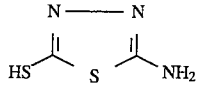
(10)
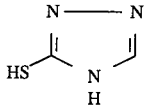
(11)
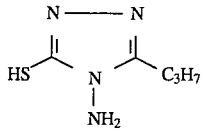
(12)
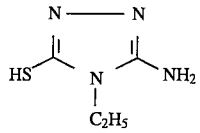
(13)
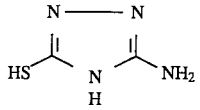
(14)
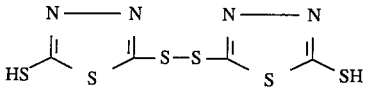
(15)
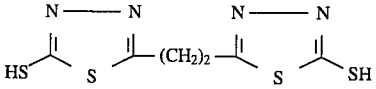
(16)
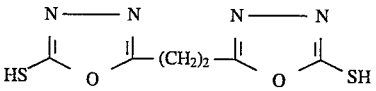
(17)
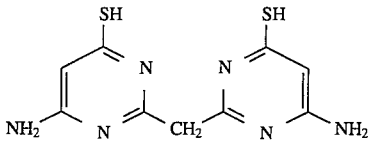
(18)
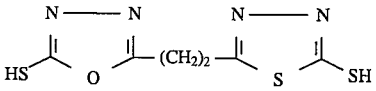
(19)
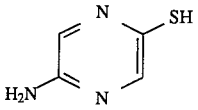
-continued
(20)
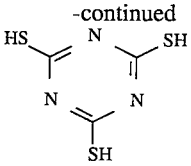
(21)
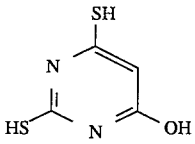
(22)
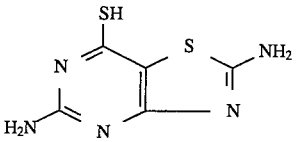
(23)
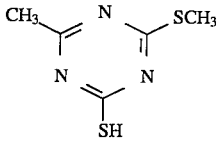
(24)
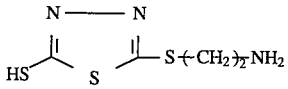
(25)
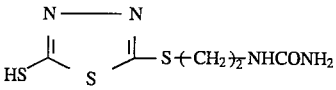
(26)
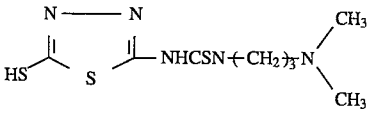
(27)
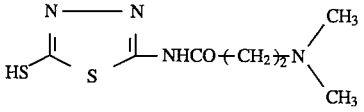
(28)
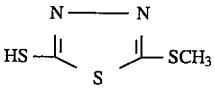
(29)
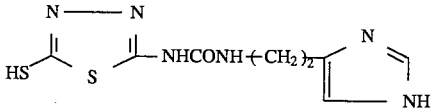
(30)
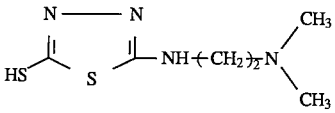
(31)
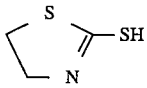
(32)
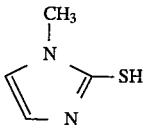

DETAILED DESCRIPTION OF THE PREFERRED EMBODIMENT

Hereunder, the present invention will be explained in detail referring to examples. However, the embodiment of the present invention is not limited thereto.

EXAMPLE 1

Next, an example of the automatic processing machine for silver halide photographic light-sensitive material of the present invention will be explained based on the attached drawings.

An example of the automatic processing machine applicable to the present invention will be explained based on FIG. 1, which is a schematic diagram of a printer processor wherein automatic processing machine A and photographic printer B are combined solidly.

Figure 1:
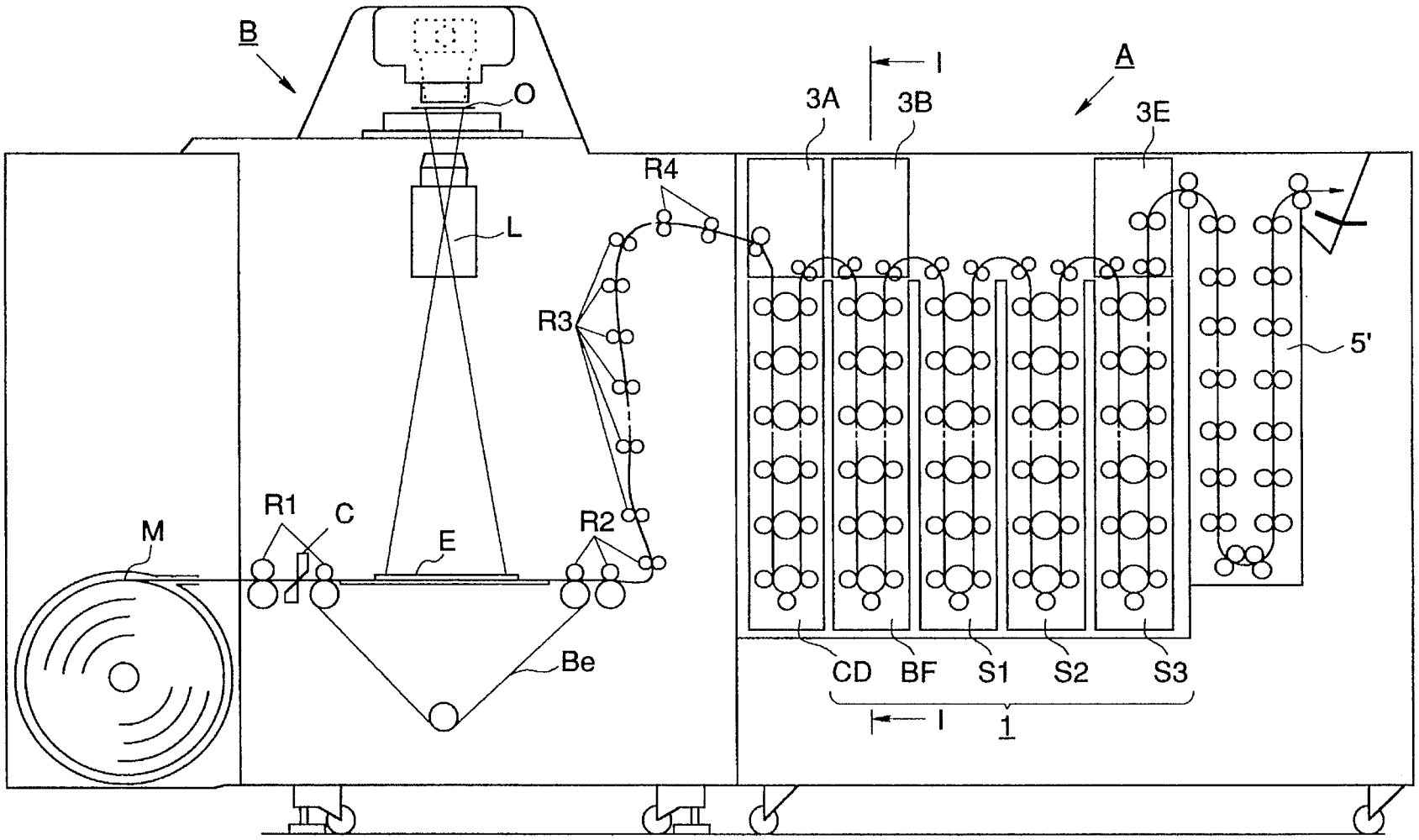
FIG. 1 shows a schematic diagram of a printer processor.

In FIG. 1, at the lower left portion of photographic printer B, there is set magazine M wherein a roll of photographic paper, which is an unexposed silver halide photographic light-sensitive material, is housed. The photographic paper fed from the magazine passes through feeding rollers R1 and cutter unit C to be cut to a prescribed size so that a sheet type photographic paper results. This sheet type photographic paper is conveyed by means of belt conveying means Be, and is exposed to an image of original photographic picture O at exposure unit E, by means of light source and lens L. The exposed sheet type photographic paper is, in addition, conveyed by several pairs of feeding rollers R2, R3 and R4, and then, introduced to automatic processing machine A. In automatic processing machine A, the sheet type photographic paper is conveyed successively to color developing tank CD, bleach-fixing tank BF, stabilizing tanks S1, S2 and S3 (substantially, processing tank 1 composed of 3 baths) which are processing tanks by means of a roller conveyance means (which have no reference marks). In each tank, the photographic paper is subjected to color developing, bleach-fixing and stabilizing. The sheet type photographic paper subjected to the above-mentioned individual processing is dried in drier unit 5' and is ejected out of the machine.

Incidentally, a one-dot chained line in the drawing shows the conveyance path of the silver halide photographic light-sensitive material. In addition, in the Example, the light-sensitive material is fed into the automatic processing machine in a cut state. However, it may also be fed into the automatic processing machine A in a continuous state. In such cases, if an accumulator which temporarily stores the light-sensitive material between automatic processing machine A and photographic printer B, processing efficiency is improved. In addition, the automatic processing machine of the present invention may be integrally constituted with photographic printer B, and it goes without saying that it may also be a single unit. In addition, the silver halide photographic light-sensitive material processed by automatic processing machine A of the present invention is not limited to an exposed photographic paper. It goes without saying that an exposed negative film may also be processed. In this explanation, an automatic processing machine having processing tank 1, composed of substantially 3 baths, having color developing tank CD, bleach-fixing tank BF and stabilizing tanks S1, S2 and S3. However, the present invention is not limited thereto. The present invention is applicable to an automatic processing machine, composed of 4 baths, having a color developing tank, a bleaching tank, a fixing tank and a stabilizing tank.

To each of the above-mentioned color developing tank CD, bleach-fixing tank BF and stabilizing tank S3, there is provided a temperature-constant tank, which is a solid processing agent charging section, communicating with the above-mentioned processing tank respectively.

Figure 2:
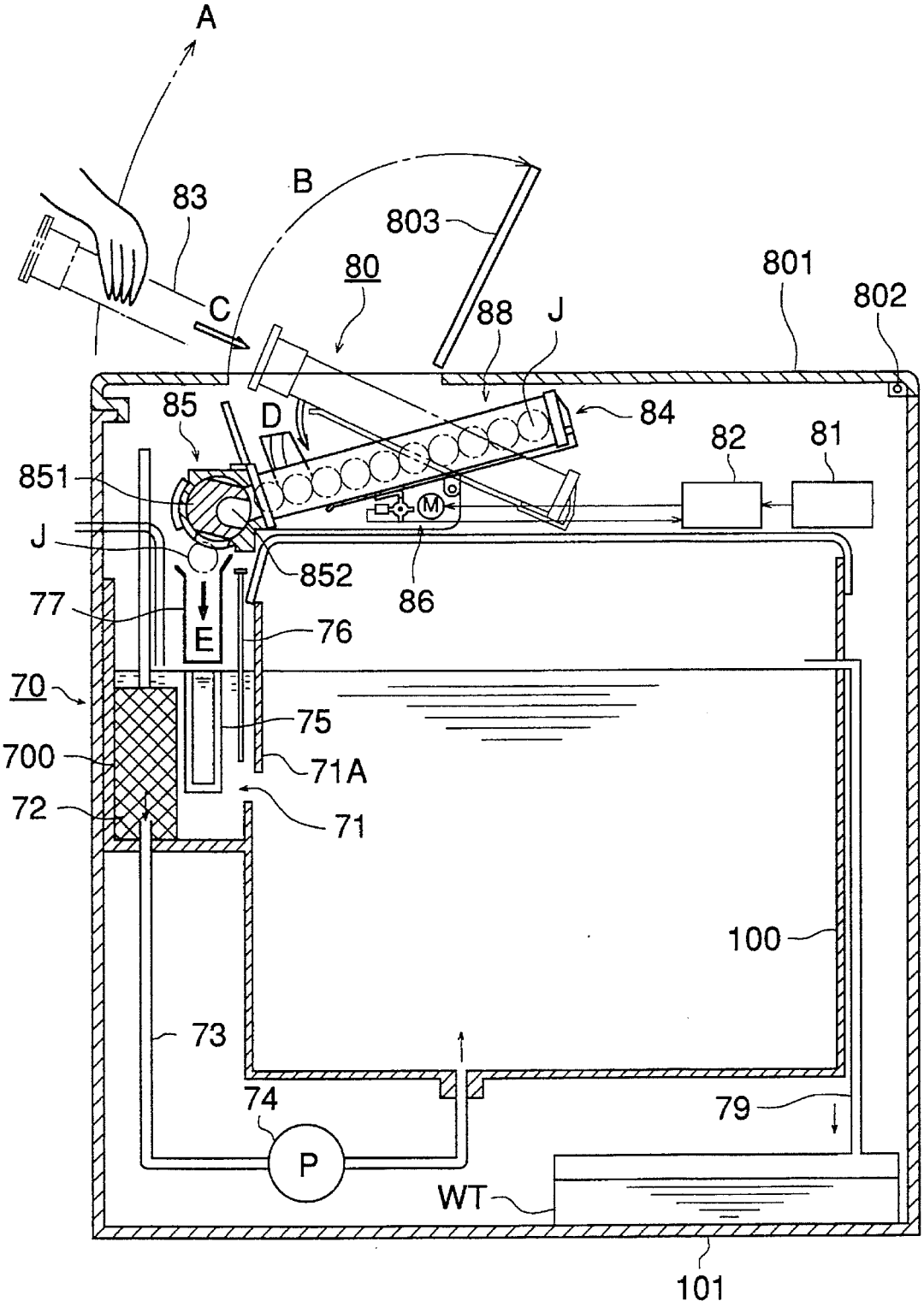
FIG. 2 shows a cross-sectional illustration of a solid processing agent charging section and a processing agent supplying means.

FIG. 2 shows a cross sectional view of a processing agent charging section and a processing agent supplying means in bleach-fixing tank BF, which shows the processing tank as a cross section I—I in FIG. 1. Incidentally, in the present invention, a solid processing agent replenishing device is provided on color developing tank CD and stabilizing tank S3 respectively so that the specific solid processing agent is chargeable to each processing tank. Namely, in FIG. 1, numerals 3A, 3B and 3E are respectively a solid processing agent replenishing device. 3A is a solid processing replenishing device for charging a tablet for color developing replenishing to color developing tank CD. 3B is a solid processing replenishing device for charging bleach-fixing replenishing tablets to bleach-fixing tank BF, and 3E is a solid processing replenishing device for charging stabilizing replenishing tablets. They are respectively mounted at positions illustrated in FIG. 1. Accordingly, color developing tank CD and stabilizing tank S3 have the same structure as bleach-fixing tank BF. Therefore, when processing tank 100 is cited, it refers to all of color developing tank CD, bleach-fixing tank BF and stabilizing tank S3. Incidentally, in each figure, in order to understand the structure more easily, the conveyance means, which conveys a light-sensitive material, is omitted. In addition, the present example explains the case when tablets are used as the solid processing agent. In addition, the replenishing device of the present invention can be used, in addition to tablets, for granules other than tablets and packed powder.

In FIG. 2, processing tank 100, which processes a light-sensitive material, has solid processing agent charging section 70, which supplies the solid processing agent (a tablet) and temperature-constant tank 700 provided integrally outside a partition wall which forms aforesaid processing tank 100. The above-mentioned processing tank 100 and temperature-constant 700 are partitioned by a wall 71A wherein there is communication hole 71 so that the processing solution can circulate between them. Below solid processing agent charging section 70 which is provided above temperature-constant tank 700, enclosure 75, which receives solid processing agent J is provided. Therefore, solid processing agent J does not move to processing tank 100 in a solid state. Incidentally, the processing solution can pass enclosure 75. However, the enclosure 75 is structured so that solid processing agent J cannot pass through a net or a filter has been developed.

A cylindrical filter 72 is provided below temperature-constant tank 700 in such a manner that the cylindrical filter 72 is capable of being replaced. The cylindrical filter 72 removes paper scraps and other foreign matters in the processing solution. The above-mentioned filter 72 is communicated to the in-feed end of the circulation pump 74 (circulation means) through circulation pipe 73 penetrating through a lower wall of temperature-constant tank 700.

Incidentally, when the processing tank in FIG. 2, is the fixing tank or the bleach-fixing tank, the processing solution fed from the washing tank or the stabilizing tank by a pump is introduced in the vicinity of a position where the replenishing agent is replenished by means of introducing pipe 78. Due to this, dissolution of the tablet is improved.

The circulation system includes the circulation pipe 73, forming a circulation passage of the processing solution, circulation pump 74 and processing tank 100. The other end of the circulation pipe 73 which is communicated with the out-feed end of the above-mentioned circulation pump 74 penetrates an outer wall of processing tank 100, so that the circulation pipe 74 is communicated with aforesaid processing tank 100. Due to the foregoing construction, when the circulation pump 74 is running, the processing solution is drawn from temperature-constant tank 700 and discharged into processing tank 100, so that the discharged processing solution is mixed with the processing solution in processing tank 100, and then sent to temperature-constant tank 700. In this way, the processing solution is circulated. The flow rate of this. circulation flow is preferably 0.1 (rotation=amount of circulation/tank volume) or more of the tank volume per minute, and more preferably 0.5 to 2.0 revolution per minute. The circulating direction of the processing agent is not limited to the direction shown in FIG. 2, but the direction may be reversed to that shown in FIG. 2.

A waste solution pipe 79 is provided for permitting the processing solution in processing tank 100 to overflow and fall into waste solution tank WT, so the processing solution level can be maintained at a constant level and an increase in the amount of components conveyed from other processing tanks can be prevented. Further, storage and increase in the amount of components oozing out from the photosensitive material can be prevented.

A rod-shaped heater 76 is arranged so that it penetrates an upper wall of temperature-constant tank 700, and is dipped in the processing solution in temperature-constant tank 700. The processing solutions in temperature-constant tank 700 and processing tank 100 are heated by this heater 76. In other words, the heater 76 is a temperature regulating means for regulating the temperature of the processing solution in processing tank 1, so that the temperature can be controlled in an appropriate range (for example, in a range from 20° to 55° C.). In addition, since heater 76 is provided in the vicinity of the charging position of the solid processing agent, it has an effect to accelerate its dissoluvability.

Throughput information sensing means 81 is provided at an entrance of automatic processing machine A, and senses the throughput of the photosensitive material to be processed. This throughput information sensing means 81 is composed of a plurality of sensing members that are provided in a transverse direction. This throughput information sensing means 81 senses the width of photosensitive material, and the result of sensing is used for counting the sensing time. Since the conveyance speed of photosensitive material is previously set in a mechanical manner, the throughput of photosensitive material, that is, the area of processed photosensitive material can be calculated from the width and time information. An infrared ray sensor, microswitch and ultrasonic sensor capable of sensing the width and conveyance time of photosensitive material can be used for this throughput information sensing means 81. A means for indirectly sensing the area of processed photosensitive material may be used for this throughput information sensing means 81. For example, in the case of the printer processor shown in FIG. 2, a means for sensing an amount of printed photosensitive material may be adopted, or alternatively, a means for sensing an amount of processed photosensitive material, the area of which is predetermined, may be adopted. Concerning the sensing time, in this example, sensing is carried out before processing, however, sensing may be carried out after processing or while the photosensitive material is being dipped in the processing solution. (In these cases, the throughput information sensing means 81 may be mounted to an appropriate position so that sensing can be conducted after processing or while the photosensitive material is being processed). In addition, in the above-mentioned explanation, sensed information was for the processed area of the light-sensitive material. However, the present invention is not limited thereto. Values which are proportional to the amount of the light-sensitive material processed or being processed are also allowed.

It is not necessary to provide the throughput information sensing means 81 for each processing tank CD, BF, S1, S2, S3, and it is preferable that one throughput information sensing means 81 is provided for one automatic processing machine A. Reference numeral 32 is a throughput supply control means for controlling the supply of processing solution in accordance with a signal sent from the throughput information sensing means 81.

Solid processing agent replenishing device 80 is provided above the processing tank of the light-sensitive material processing device which processes exposed light-sensitive material. It is composed of housing container 88, housing container loading means 84, supplying means 85, processing agent supplying plate 851, groove 852 and driving means 86, and it is tightly closed by upper cover 801. The above-mentioned upper cover 801 is supported rotatably by main body 101, which houses the above-mentioned processing tank 100 and temperature-constant tank 700, and axis 802 on the rear side of the main body. Aforesaid upper cover 801 inspects solid processing agent replenishing device 80 and replaces the above-mentioned filter 72 by being lifted to a one-dot chain line A direction in the Fig. and by opening the front surface and the upper surface largely from the operator's position.

In addition, above the above-mentioned upper cover 801, skylight 803 is pivoted so that aforesaid skylight 803 can be opened to one-dot chain line B in the drawing. Due to this, the above-mentioned housing container 88 is easily attached or replaced.

FIGS. 3(A) to 3(E) show various configurations of the tablet type solid processing agent J. FIG. 3(A) is a sectional view of the cylindrical flat tablet type solid processing agent J, wherein the configuration is circular and the corners are chamfered by the radius of curvature of r. FIG. 3(E) is a perspective view of the tablet type solid processing agent J. FIG. 3(B) is a sectional view of the flat tablet type solid processing agent J, wherein the configuration is circular, and the upper and lower surfaces are flat, and the circumferential surface is formed convex by the radius of curvature of R. FIG. 3(C) is a sectional view of the tablet type solid processing agent J, wherein the configuration is flat, and the upper and lower surfaces are formed spherical. FIG. 3(D) is a sectional view of the tablet type solid processing agent J, wherein the configuration is a doughnut-shape having a hole at the center.

Figure 3:
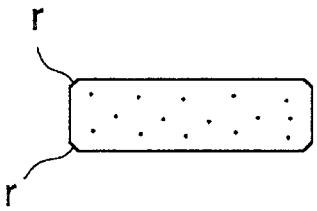
FIGS. 3(A) to 3(E) show various shapes of tablet-shaped solid processing agents.
Figure 3:
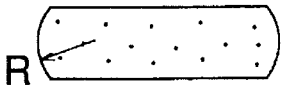
Figure 3:
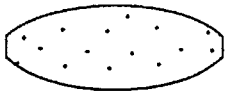
Figure 3:
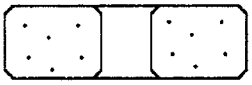
Figure 3:
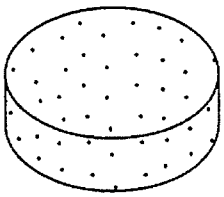

Next, solid processing agent replenishing device 80, which replenishes solid processing agent (hereinafter, referred also as "tablet") J having shapes exhibited in FIG. 3, will be explained referring to FIG. 2.

In FIG. 2, tablet J is housed in housing container 88. As stated above, after skylight 803 is opened to an illustrated one-dot line B, housing container 88 wherein tablet J is housed therein is inserted as illustrated by hollow-arrowed direction C to be loaded into housing container loading means 84. Next, housing container 83 is, together with housing container loading means 814, rotated to illustrated hollow-arrowed direction D so that loading of housing container 83 into housing container loading means 84 is completed. Under this condition, since housing container 83 is, as exhibited, inclined with its left to be side lower, tablets J housed in housing container 83 are urged to move toward the left side by gravity.

In accordance with information from throughput information sensing means 81 based on the processing amount of the light-sensitive material, throughput supply controlling means 82 is operated and motor M of driving means 86 is ready to drive so that processing agent supplying plate 851, located inside supplying means 85 which is driven by a driving force transmitting means illustrated is rotated clockwise.

Cavity 852 provided on processing agent supplying plate 851 is so arranged that, when processing agent supplying plate 851 is rotated so that the position of tablet J and that of cavity 852 are aligned, tablet J rolls into cavity 852. Accordingly, in the above-mentioned situation, tablet J is rotated into cavity 852 on processing agent supplying plate 851 so that a row of tablet J moves to the left by a length of one tablet. Next, when processing agent supply plate 851 further rotates and cavity 852 faces downward, tablet J therein is introduced hollow-arrowed direction E toward chute 77 and falls into enclosure 75 in solid processing agent charging section 70. Then, as stated above, tablet J is dissolved in enclosure 75 and mixed with the processing solution for replenishing the processing solution.

Figure 4:
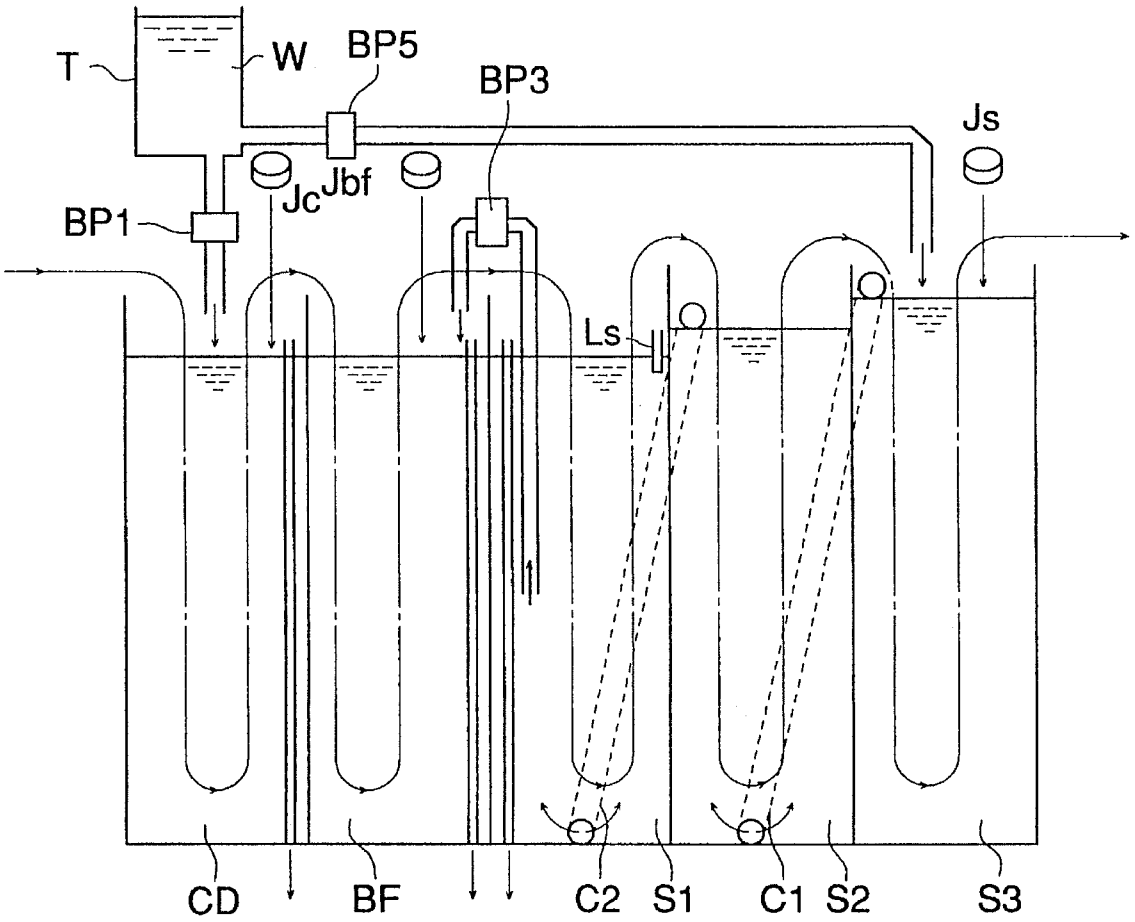
FIG. 4 shows a diagram of the automatic processing machine.

Next, an example of the automatic processing machine of the present invention will be explained further in detail, referring to FIG. 2 and 4. FIG. 4 is a diagram showing mainly a structure related to the present invention with each processing tank of automatic processing machine A of FIG. 2 as typical ones.

In FIG. 4, in the same manner as in FIG. 1, a light-sensitive material, i.e. exposed photographic paper or film, is conveyed through each processing tank, i.e., color developing tank CD, bleach-fixing tank BF and stabilizing tank S1, S2 and S3 in accordance with an arrow shown with a one-dashed chain line so that it is subjected to each processing mentioned above.

In the present example, a light-sensitive material is processed under the following processing conditions.

| Processing tank | Processing temperature (°C.) | Processing time (sec.) | Replenishing amount | Volume of tank |
|---|---|---|---|---|
| Color developing tank (CD) | 39.8 | 22 | 65 | 2 (l) |
| Bleach-fixing tank (BF) | 35–40 | 22 | 80 | 2 (l) |

-continued

| Processing tank | Processing temperature (°C.) | Processing time (sec.) | Replenishing amount | Volume of tank |
|---|---|---|---|---|
| Stabilizing tank (S1) | 30–40 | 22 | — | 2 (l) |
| Stabilizing tank (S2) | 30–40 | 22 | — | 2 (l) |
| Stabilizing tank (S3) | 30–40 | 22 | 180 | 2 (l) |

In the above-mentioned processes, the amount of replenishing water for the bleach-fixing tank BF, i.e. 80 (ml/m$^2$) is the amount supplied from the stabilizing tank S1 to the bleaching tank BF by pump BP3.

The stabilizing tank S3 is supplied with replenishing water of 180 (ml/m$^2$) by pump BP5. By supplying the replenishing water of 180 (ml/m$^2$) to the stabilizing tank S3, solution of 180 (ml/m$^2$) overflows as the replenishing water from the stabilizing tank S3 to the stabilizing tank S2, also, from the stabilizing tank S2 to the stabilizing tank S1. That is, in FIG. 4, the bleach-fixing tank BF, and the stabilizing tanks S1, S2, S3 are the series of processing tanks which are communicated with each other through the shifting means, and a tank T is a replenishing water tank.

Next, a processing agent for color paper, as shown below, was prepared.

<Tablet for replenishing color developing solution for color paper>

Procedure (1)

In a commercially available bandam mill, 40 g of disodium salt of disulfoethylhydroxyamine, 170 g of sodium paratoluenesulfonic acid, 30 g of Chinopal SFP (produced by Chiba-Geigy), 23 g of diethylenetriamine pentaacetic acid and 28 g of Pine Flow (produced by Matsutani Chemical Co., Ltd.) were crushed to an average grain size of 10 μm. In a commercially available stirring and tableting machine, the above-mentioned fine powder was granulated by preparing for 7 minutes by adding about 30 ml of water, and then, the granulated product was dried for 30 minutes at 60° C. by means of a fluidized bed layer drier so that moisture in the granulated product was substantially removed. To the granulated product prepared in the above-mentioned manner, 3 g of sodium N-myrystoil-N-methyl-β-alanine was added. The resulting compound was mixed for 3 minutes by the use of a compound mixer in a room wherein conditions were regulated to 25° C. and 40% RH or less.

Procedure (2)

In a commercially available bandam mill, 145 g of a developing agent CD-3 {4-amino-3-methyl-N-ethyl-N[β-(methanesulfonamide)ethyl]aniline sulfate} was crushed until the average grain size becomes 10 μm. In a commercially available stirring and tableting machine, the above-mentioned fine powder was granulated by preparing for 7 minutes by adding about 20 ml of water, and then, the granulated product was dried for 2 hours at 40° C. in a fluidized bed layer drier so that any moisture in the granulated product was substantially removed. To the granulated product prepared in the above-mentioned manner, 100 g of polyethylene glycol 6000 was mixed uniformly for 10 minutes in a room regulated to 25° C. and 40% RH or less. Next, to the above-mentioned resulting mixture, 1 g of sodium N-myrystoil-N-methyl-β-alanine was added, and then, mixed for 3 minutes.

Procedure (3)

In the same manner as in Procedure (10), 130 g of sodium paratoluenesulfonic acid, 3.5 g of sodium sulfite, 65 g of potassium hydroxide, 100 g of polyethylene glycol 6000, 330 g of potassium carbonate and 60 g of Mannitol were crushed, and then, the resulting was mixed by the use of a commercially available mixer. Next, in the same manner as in procedure (1), the resulting mixture was granulated while adding 20 ml of water. After granulating, the granulated product was dried for 30 minutes at 60° C. so that moisture in the granulated product was substantially removed. To the regulated granulated product, 7 g of sodium N-myrystoil-N-methyl-β-alanine were added, and then, mixed for 3 minutes in a room regulated to 25° C. and 40% RH or less.

Next, the granulated products produced in Procedures (1), (2) and (3) were mixed for 30 minutes, and then, the resulting mixture was subjected to compression tableting at a filling rate of 10 g per unit by the use of a tableting machine wherein Tough Press Correct 1527HU produced by Kikusui Seisakusho was modified so that tablets for replenishing color developing for color paper Whose particle diameter was 30 mm and thickness was 10 mm were prepared.

<Tablet for replenishing bleach-fixing for color paper>

Procedure (4)

In a commercially available bandam mill, 720 g of ferric ammonium salt of diethylenetriamine pentaacetic acid, 70 g of diethylenetriamine pentaacetic acid and 80 g of Pine Flow (produced by Matsutani Chemical Co., Ltd.) were crushed. Thirty ml of resulting compound was placed in a stirring and granulating machine for about 10 minutes. After granulating, the resulting granulated product was dried at 60° C. for 2 hours so that moisture in the granulated product was substantially removed. The average particle diameter of this granulated product was set to 800 μm, and 50% or more of the particles deviated from ±200 through ±250 μm.

Procedure (5)

In the same manner as in Procedure (1), 80 g/720 g of sodium thiosulfate/ammonium thiosulfate, 8 g of the compound described in Table 2, 160 g of sodium sulfite, 60 g of sodium bisulfite and 60 g of Pine Flow (produced by Matsutani Chemical Co., Ltd.) were crushed, mixed and granulated, using 40 ml of water. After granulating, the granulated product was dried at 60° C. for 120 minutes so that moisture therein was substantially removed. The average particle diameter was 800 μm. 50% or more of the particles deviating by ±200 through ±250 μm.

Granulated products obtained through the above-mentioned procedures (4) and (5) were mixed. To the mixture, 10 g of sodium N-lauloylsulcocine was added. The resulting mixture was mixed for 5 minutes on a room wherein conditions were prepared to 25° C. and 40% RH or less by the use of a mixer. Next, the resulting mixture was tableted in a filling rate of 10 g per unit by a tableting machine wherein Tough Press Correct 1527HU produced by Kikusui Seisakusho was modified so that tablets for replenishing bleach-fixing for color paper whose particle diameter was 30 mm and thickness was 10 mm was prepared.

<Tablet for replenishing stabilizing for color paper>

In the same manner as in Procedure (1), 10 g of sodium carbonate monohydrate, 200 g of disodium 1-hydroxyethane-1,1-diphosphonic acid, 150 g of Chinopal SFP, 300 g of sodium sulfite, 20 g of zinc sulfate heptahydrate, 150 g of disodium ethylenediamine tetraacetic acid, 200 g of ammonium sulfate, 10 g of o-phenylphenol and 25 g of Pine Flow were crushed and mixed for granulating.

The added amount of water was 60 ml. After granulating, the resulting granulate was dried at 70° C. for 60 minutes so that moisture therein was substantially removed. To the granulated product, 10 g of sodium N-lauloylsulcocine was added, and then, mixed for 3 minutes by the use of a mixer in a room wherein conditions were regulated to 25° C. and 40% RH or less. Next, the resulting mixture was tableted wherein a filling rate per one tablet was 10 g by the use of a tableting machine wherein Tough Press Correct 1527HU produced by Kikusui Seisakusho Co., Ltd. was modified so that tablets for replenishing stabilizing for color paper whose particle diameter was 30 mm and thickness was 10 mm.

By the use of the above tablets, light-sensitive materials were subjected to continuous processing by the following procedure under the condition that ambient circumstances were set to 25° C. in temperature and 50% RH in humidity. Evaporation amount A (ml/H) from each processing tank was measured when each processing tank was subjected to temperature control so as to maintain the predetermined temperature indicated in the abovementioned processing condition, and evaporation amount B (ml/H) from each processing tank was measured when each processing tank was not subjected to temperature control. Reference M represents the total evaporation amount per day obtained from the formula (1) in which the temperature control was conducted for 10 hours per day and was not conducted for 14 hours under the above ambient circumstances.

TABLE 1

| | A (ml/H) | B (ml/H) | M (ml/day) |
|---|---|---|---|
| CD | 2.0 | 0.92 | 32.8 |
| BF | 1.1 | 0.57 | 19.2 |
| S1 | 1.0 | 0.42 | 16.0 |
| S2 | 1.1 | 0.35 | 15.8 |
| S3 | 2.4 | 1.2 | 40.8 |

$M = A \times 10 + B \times 14 - (1)$

Light-sensitive materials were continuously processed while the amount of evaporation compensation water was regulated as shown in Table 2. Incidentally, in the present example, the amount of evaporation compensation water for Tanks BF, S1, S2, S3 were collectively replenished into Tank S3 (these tanks are a series of processing tanks in which each tank is adapted to communicate solution to the neighboring tanks). This is defined to be Embodiment 1 (the present invention). To the contrary, in Embodiment 2 (outside of the present invention), evaporation compensation water for Tank BF is replenished into Tank BF and evaporation compensation water for Tank S3 is replenished into Tank S3 (in other words, evaporation compensation water is replenished into each respective tank).

Incidentally, the compensation water for the time that temperature control was not conducted was collectively supplied in the amount corresponding to the evaporation for 14 hours at a time right before temperature control was started and the compensation water for the time that temperature control was conducted was collectively supplied in the amount corresponding to the evaporation for one hour for every hour.

The amount of evaporation compensation in the present invention is the total amount for Tanks BF, S1, S2, S3.

Continuous processing was conducted to process the light sensitive material in the amount of 2.6 $m^2$ per day and continued until the solution of-the processing tank was replaced in one cycle with the replenishing solution.

After the continues processing test was finished, the density of HYPO in Tanks S1, S2, S3 was measured by means of iodine titration. The density of diethylenetriamine pentaacetic acid in Tank S1 was measured by means of Fe chelate titration, and is indicated as a ratio to the initial density in Table 2. In addition, occurrence of yellow and magenta staining on white background portions of processed color paper was observed, and then, evaluated as follows.

(Occurrence of stain)

A: No staining visually observed at all.

B: Negligible staining is observed. There is no problem.

C: Slight staining is observed.

D: Obvious staining is observed visually, reduced commercial value.

E: Prominent staining, extremely reduced commercial value

To evaluate storage stability of processed images, processed color paper was stored for 10 days in an incubator at 85° C. and 60% RH so that yellow staining was measured. staining is prevented. In addition, yellow staining after images are stored can also be prevented.

EXAMPLE 2

By using the apparatus shown in FIG. 4 and the processing solid agents which were used in Example 1, the processing test was conducted by changing the amount of replenisher water as follows, and then, the same evaluation as for Example 1 was adopted.

TABLE 2

| Experiment No. | Embodiment Type | Amount of make-up water (ml/day) S3 | Coefficient k | Density S1 (%) | Density of HYPO in Tank P-3 (g/l) Tank S1 | Tank S2 | Tank S3 | Storage stability of image | Condition of the occurrence of stain | Inside/outside the invention |
|---|---|---|---|---|---|---|---|---|---|---|
| 1-1 | 1 | 108 | −0.2 | 65 | 5.5 | 0.55 | 0.05 | 0.14 | C | Outside |
| 1-2 | 1 | 100 | −0.1 | 70 | 5.9 | 0.64 | 0.06 | 0.12 | B | Inside |
| 1-3 | 1 | 92 | 0 | 75 | 6.5 | 0.74 | 0.067 | 0.11 | B | Inside |
| 1-4 | 1 | 84 | 0.1 | 82 | 7.2 | 0.88 | 0.085 | 0.10 | A | Inside |
| 1-5 | 1 | 76 | 0.2 | 89 | 8.01 | 1.05 | 0.108 | 0.10 | A | Inside |
| 1-6 | 1 | 69 | 0.3 | 98 | 9.0 | 1.29 | 0.141 | 0.12 | B | Inside |
| 1-7 | 1 | 61 | 0.4 | 109 | 10.4 | 1.61 | 0.188 | 0.15 | C | Outside |
| 1-8 | 1 | 53 | 0.5 | 122 | 12.3 | 2.08 | 0.26 | 0.17 | D | Outside |
| 1-9 | 2 | 92 | 0 | 88 | 8.50 | 1.38 | 0.20 | 0.12 | C | Outside |
| 1-10 | 2 | 76 | 0.2 | 113 | 11.3 | 0.15 | 0.34 | 0.15 | D | Outside |
| 1-11 | 2 | 53 | 0.5 | 136 | 15.8 | 3.53 | 0.61 | 0.18 | D | Outside |

k = (amount of evaporated water − amount of make-up water)/(amount of light-sensitive material processed × replenished amount)
amount of evaporated water: amount of evaporated water from a series of processing tanks per day (ml)
amount of make-up water: amount of make-up water collectively supplied per day (ml)
amount of light-sensitive material processed: amount of light-sensitive material processed per day ($m^2$)
replenished amount: amount of processing solution supplied for processing 1 $m^2$ of light-sensitive material As can be understood from Table 2, when evaporation compensation water is replenished collectively at the final process tank (the present invention) and k value is also within the present invention, especially, the k value is in the range of $0<k<0.3$, the carrying in ratio from the bleach-fixing solution is kept low and thereby the occurrence of

TABLE 3

| Experiment No. | Embodiment Type | Replenish amount ($ml/m^2$) | Interval of charging a tablet ($m^2$/1J)* | Amount of make-up water (ml/day) S3 | Coefficient k | Density S1 (%) | Density of HYPO in Tank S (g/l) Tank S1 | Tank S2 | Tank S3 | Storage stability of image | Condition of the occurrence of stain | Inside/outside the invention |
|---|---|---|---|---|---|---|---|---|---|---|---|---|
| 2-1 | 1 | 150 | 0.24 | 105 | −0.2 | 63 | 6.53 | 0.74 | 0.067 | 0.15 | C | Outside |
| 2-2 | 1 | 120 | 0.3 | 102 | −0.2 | 59 | 8.08 | 1.06 | 0.11 | 0.16 | D | Outside |
| 2-3 | 1 | 100 | 0.36 | 101 | −0.2 | 56 | 9.43 | 1.36 | 0.15 | 0.18 | D | Outside |
| 2-4 | 1 | 80 | 0.45 | 99 | −0.2 | 52 | 11.5 | 1.88 | 0.22 | 0.20 | D | Outside |
| 2-5 | 1 | 150 | 0.24 | 85 | 0.1 | 78 | 8.61 | 1.17 | 0.12 | 0.11 | A | Inside |
| 2-6 | 1 | 120 | 0.3 | 87 | 0.1 | 72 | 10.2 | 1.55 | 0.18 | 0.12 | B | Inside |
| 2-7 | 1 | 100 | 0.36 | 88 | 0.1 | 68 | 12.1 | 2.03 | 0.25 | 0.13 | B | Inside |
| 2-8 | 1 | 80 | 0.45 | 88 | 0.1 | 62 | 14.7 | 2.78 | 0.37 | 0.15 | B | Inside |
| 2-9 | 2 | 150 | 0.24 | 85 | 0.1 | 93 | 12.1 | 2.47 | 0.42 | 0.15 | D | Outside |
| 2-10 | 2 | 120 | 0.3 | 87 | 0.1 | 84 | 15.7 | 3.85 | 0.78 | 0.16 | D | Outside |
| 2-11 | 2 | 100 | 0.36 | 88 | 0.1 | 75 | 19.3 | 5.40 | 1.21 | 0.17 | D | Outside |

*Area processed by one tablet

As can be understood from Table 3, even when the amount of compensation water is reduced and the replenishing amount was lowered, in the case that the compensation water is replenished collectively at the final-process tank and coefficient value is within the present invention, the occurrence of yellow staining over time can be reduced.

EXAMPLE 3

Figure 5:
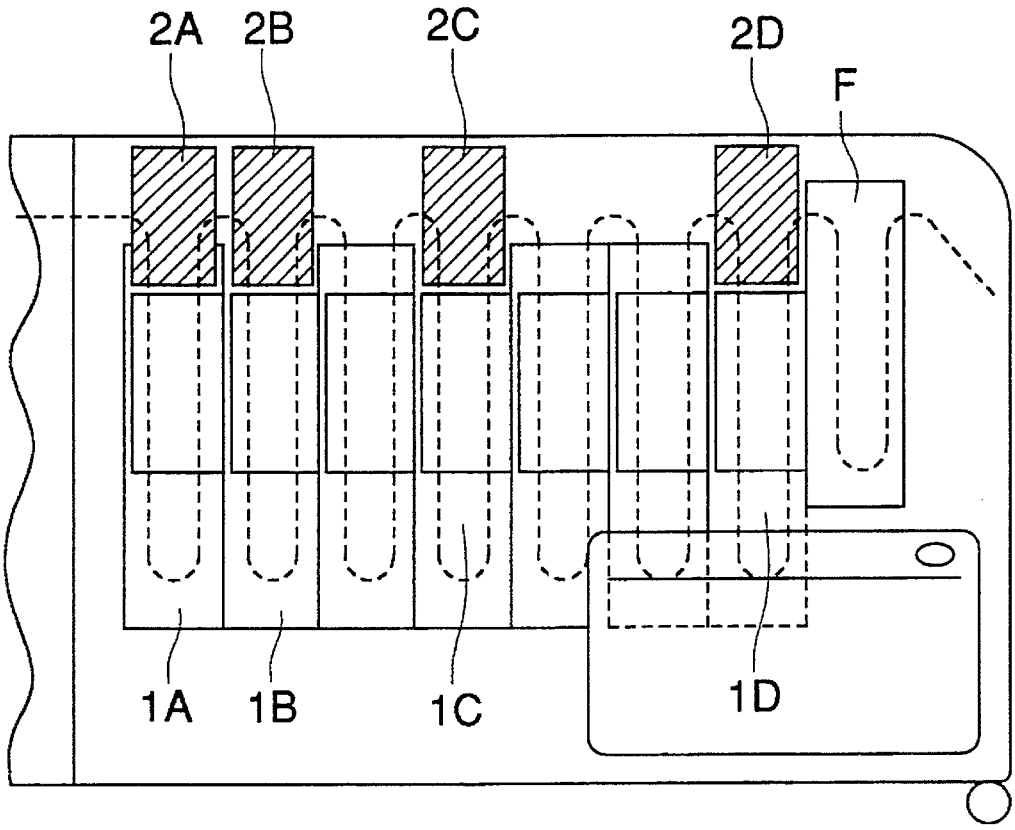
FIG. 5 is a diagrams showing positions of mounting solid processing agent replenishing devices on the automatic processing machine.
Figure 6:
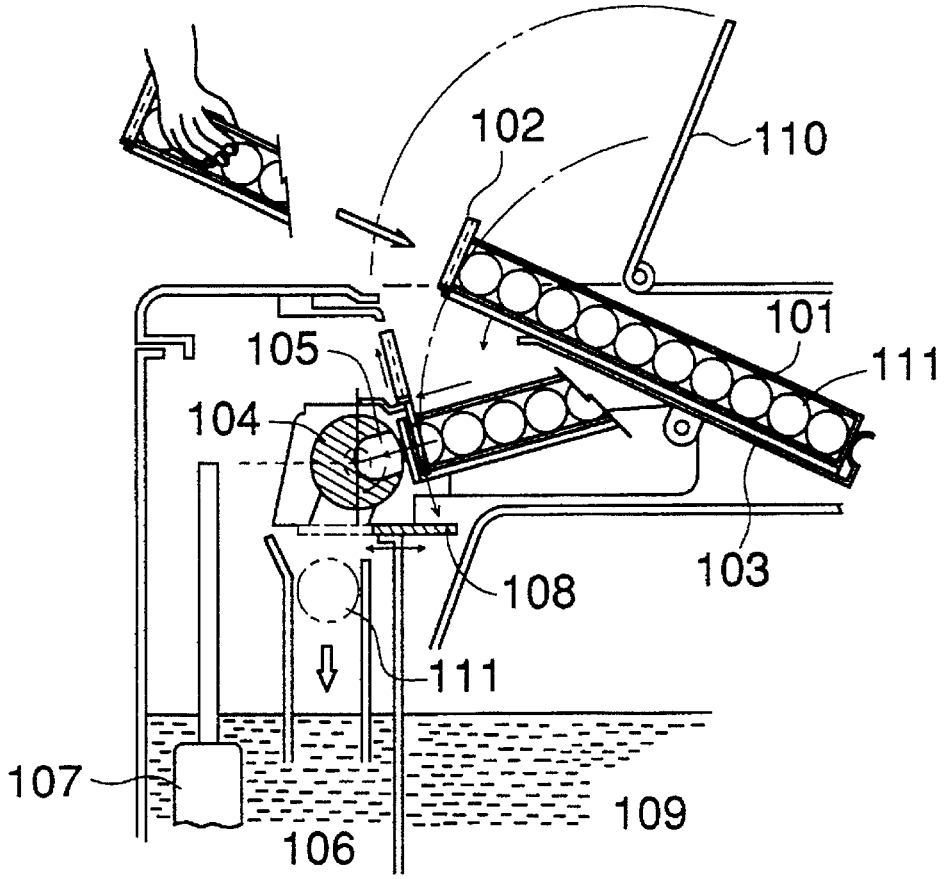
FIG. 6 is a diagram showing a solid processing agent supplying (charging) device.

The replenishing unit of color negative film processor CL-KP-50QA was modified as shown in FIG. 5. In addition, with regard to a solid processing agent supplying (charging) device wherein the tank volume was modified as follows, one which is shown in FIG. 6 was used. After Konica Color Super Film DD100 was subjected to imagewise exposure, a cylindrical container wherein tablets are housed was set into the tablet charging unit. Processing was conducted at a rate of 15 rolls per day.

FIG. 5 is a drawing showing a position where solid processing agent replenishing devices 2A, 2B, 2C and 2D of the present invention were mounted onto KP-50QA (the automatic processing machine (hereinafter, also referred to as "automatic machine"). The above-mentioned solid processing agent replenishing devices 2A, 2B, 2C and 2D were respectively mounted at positions, above color developing tank 1A, bleaching tank 1B, fixing tank 1C and stabilizing tank 1D, shown with biases. FIG. 6 is a diagram showing an example of the above-mentioned solid processing agent replenishing (charging) devices 2A, 2B, 2C and 2D. A the side of each tank, a dissolution room 106 to which solid processing agent 111 is charged is provided.

In FIG. 6, solid processing agent (hereinafter, referred to as tablet or tablet chemical) 111 is housed in a container (cartridge 101) which was divided into plural partitions. The container 101 was sealed tightly by means of a slide type cap 102. When this cartridge is set into cartridge supporting stand 103 of the solid processing agent automatic supplying device mounted above the upper portion of the automatic processing machine, cap 102 is opened. From the slanted cartridge, tablet is rotated and falls into pocket 105. Pocket 105 of the above-mentioned cylinder 104 is cut alternately so as not that plural tablets housed in another room in the cartridge rotate and falling concurrently.

Hereunder, various processing steps will be shown.

| Processing tank | Processing time (sec.) | Processing temperature (°C.) | Replenishing amount | Volume of tank |
|---|---|---|---|---|
| Color developing (N-1) | 3 min. and 15 sec. | 38.0° C. | 520 ml/m² | 10.0 (l) |
| Bleaching (N-2) | 45 sec. | 38.0° C. | 100 ml/m² | 3.0 (l) |
| Fixing-1 (N-3-1) | 45 sec. | 38.0° C. | | 3.0 (l) |
| Fixing (N-3-2) | 45 sec. | 38.0° C. | 730 ml/m² | 3.0 (l) |
| Stabilizing 1 (N-4-1) | 20 sec. | 38.0° C. | | 1.5 (l) |
| Stabilizing 2 (N-4-2) | 20 sec. | 38.0° C. | | 1.5 (l) |
| Stabilizing 3 (N-4-3) | 20 sec. | 38.0° C. | 860 ml/m² | 1.5 (l) |
| Drying | 80 sec. | 55° C. | | |

The fixing step and the stabilizing step are a counter current system, wherein solutions flow from fixing-2 fixing-1, from stabilizing-3 to stabilizing-2 and from stabilizing-2 to stabilizing-1. In the bleaching tank, aeration is conducted using an air pump.

When starting, the tank solution was prepared by the use of a replenishing solution and a starter of Konica's processing agent CNK-4-52 for color negative film.

Next, a processing agent for color negative film, as stated below, was prepared.

1) Tablet for replenishing color developing for color negative film

Procedure (1)

In a commercially available hammer mill, 60 g of developing agent CD-4 [4-amino3-methyl-N-ethyl-N[β-(hydroxy) ethyl] were crushed to an average grain size of 10 μm. This fine powder was granulated in a stirring and granulating machine by adding 10 ml of water for 7 minutes at an ambient temperature. Next, the granulated product was dried for 2 hours at 40° C. in a fluid bed layer drier so that all moisture in the granulated product was substantially removed. Thus, granule (1) for the replenishing color developing solution for color negative film were prepared.

Procedure (2)

In the same manner as in Procedure (1), 69.4 g of hydroxylamine sulfate and 4 g of Pine Flow (produced by Matsutani Chemical) were crushed, mixed and the resulting mixture was granulated. The amount of water added was 3.5 ml. After granulating, the granulated product was dried for 30 minutes at 60° C. so that moisture in the granulated product was substantially removed. Thus, granule (2) for the replenishing color developing solution for color negative film were prepared.

Procedure (3)

In the same manner as in Procedure (1), 15 g of disodium 1-hydroxyethane-1,1-diphosphonic acid, 72.8 g of potassium sulfite, 350 g of potassium carbonate, 3 g of sodium hydrogencarbonate, 3,7 g of sodium bromide, 22 g of Mannit and 5.0 g of polyethylene glycol 6000 were crushed, mixed and the resulting mixture was granulated, using 40 ml of water. After granulating, the granulated product was dried for 60 minutes at 70° C. so that moisture in the granulated product was substantially removed. Thus, granules (3) for the replenishing color developing solution for color negative film were prepared.

The above-mentioned granules (1) through (3) for the replenishing color developing solution for color negative film were mixed. To this mixture, 2 g of sodium N-myrystoil alanine were added, and mixed for 10 minutes uniformly by the use of a mixer in a room wherein conditions were prepared to 25° C. and 40% RH or less. Next, the mixture was tableted at a fill rate of 10 g per tablet by the use of a tableting machine wherein Tough Press Correct 1527HU produced by Kikusui Seisakusho was modified so that tablets for replenishing color developing solution for color negative film of diameter 30 mm was prepared.

2) Tablet for replenishing bleach-fixing solution for color negative film

Procedure (4)

In the same manner as in Procedure (1), 175 g of 1,3-propanediamine tetraacetic acid ferric ammonium monohydrate, 2 g of 1,3-propanediamine tetraacetic acid and 17 g of Pine Flow (produced by Matsutani Chemical) were crushed, mixed and the resulting mixture was granulated, using 8 ml of water. After granulating, the granulated product was dried for 30 minutes at 60° C. so that moisture in the granulated product was substantially removed.

Procedure (5)

In the same manner as in Procedure (H), 133 g of citric acid, 200 g of ammonium bromide and 10.2 g of Pine Flow were crushed, mixed and the resulting mixture was granulated, using 17 ml of water. After granulating, the granulated product was dried for 60 minutes at 70° C. so that moisture in the granulated product was substantially removed.

Procedure (6)

In the same manner as in Procedure (H), 66.7 g of potassium sulfate, 60 g of potassium hydrogencarbonate and 8 g of Mannit were crushed, mixed and the resulting mixture was granulated, using 13 ml of water. After granulating, the granulated product was dried for 60 minutes at 60° C. so that moisture in the granulated product was substantially removed.

The granulated products prepared by means of the above-mentioned procedures (4) through (6) for replenishing color developing solution for color negative film were mixed for 10 minutes uniformly by the use of a mixer in a room wherein conditions were prepared to 25° C. and 40% RH or less. Next, to the mixture, 6 g of sodium N-myrystoil alanine was added and mixed for 3 minutes, and then, the mixture was tableted at a fill rate of 10 g per tablet by the use of a tableting machine wherein Tough Press Correct 1527HU was produced by Kikusui Seisakusho was modified so that tablets for replenishing the bleach-fixing solution for color negative film of diameter 30 mm and of thickness 10 mm was prepared.

3) Tablet for replenishing fixing solution for color negative film

Procedure (7)

In the same manner as in Procedure (1), 250 g/2250 g of sodium thiosulfate/ammonium thiosulfate, 180 g of sodium sulfite, 20 g of potassium carbonate, 20 g of ethylenediamine tetraacetic acid disodium salt and 70 g of Pine Flow (produced by Matsutani Chemical Co., Ltd.) were crushed until its average particle size becomes 30 μm. This powder was granulated in a stirring granulating machine for about 10 minutes at room temperature by adding 50 ml of water. After granulating, the granulated product was dried in a fluid bed layer drier at 60° C. for 120 minutes so that moisture therein was substantially removed. The particle diameter averaged 800 μm, with 50% or more deviating by ±200 through ±250 μm.

Procedure (8)

To the above-mentioned granule for replenishing the fixing solution, 30 g of sodium N-myristoyl alanine was mixed for 5 minutes by the use of a mixer in a room wherein conditions were prepared to 25° C. and 45% RH or less. Next, the mixture was tableted at a fill rate of 10 g per tablet by the use of a tableting machine wherein Tough Press Correct 1527HU was produced by Kikusui Seisakusho was modified so that tablets for replenishing the bleach-fixing solution for color negative film whose diameter was 30 mm and the thickness was 10 mm was prepared.

4) Tablet for replenishing the stabilizing solution for color negative film

Procedure (9)

In the same manner as in Procedure (1), 150 g of m-hydroxybenzaldehyde, 20 g of sodium lauryl sulfate, 60 g of disodium ethylenediamine tetraacetic acid, 65 g of lithium hydroxide monohydrate and 10 g of Pine Flow were crushed, mixed and the resulting mixture was granulated, using 10 ml of water. After granulating, the granulated product was dried for 2 hours at 50° C. so that moisture in the granulated product was substantially removed.

Procedure (8)

In a room wherein conditions were prepared to 25° C. and 40% RH or less, the above-mentioned granulated product prepared by means of the above-mentioned procedure was tableted at a fill rate of 10 g per tablet by the use of a tableting machine wherein Tough Press Correct 1527HU was produced by Kikusui Seisakusho was modified so that tablets for replenishing the stabilizing solution for color negative film whose diameter was 30 mm and the thickness was 10 mm was prepared.

The above-mentioned tablets for replenishing solution for color negative film were charged in the processing tanks at intervals shown in Table 4.

TABLE 4

| | Interval of charging a replenishing tablet |
|---|---|
| Tablet for replenishing color developing | One tablet was charged per 8.3 rolls of color negative film (24 EX) |
| Tablet for replenishing bleaching | One tablet was charged per 5.2 rolls of color negative film (24 EX) |
| Tablet for replenishing fixing | One tablet was 10 g. One tablet was charged per 1.5 rolls of color negative film (24 EX) |
| Tablet for replenishing stabilizing | One tablet was charged per 131 rolls of color negative film (24 EX) |

Evaporation amount A from each processing tank when conditions were regulated to 25° C. and 50% RH and the evaporation amount B at unregulated conditions were measured, and from these values evaporation amounts per day were calculated in the same manner as in Table 1.

Amount of evaporation compensation water was regulated as shown in Table 5, and continuous processing was conducted. The continuous processing was conducted up to 1.0 rotation, and the processing amount per day was 10 rolls in terms of 135 mm and 24EX.

The total evaporation compensation water from the first tank of N-3 to the third tank of N-4 was replenished at the third tank of N-4. This is defined to be Embodiment 1. Conversely, the case where evaporation compensation water is replenished to each tank is defined to be Embodiment 2.

Compensation water amount is defined to be the total evaporation compensation water amount from the first tank of N-3 to the third tank of N-4.

TABLE 5

| | A (ml/H) | B (ml/H) | M (ml/day) |
|---|---|---|---|
| N-1 | 5.1 | 3.2 | 96 |
| N-2 | 5.0 | 1.2 | 67 |
| N-3-1 | 2.9 | 0.8 | 40 |
| N-3-2 | 6.3 | 2.1 | 92 |
| N-4-1 | 3.0 | 1.3 | 48 |
| N-4-2 | 3.1 | 1.4 | 50 |
| N-4-3 | 13.8 | 6.4 | 227 |

After continuous processing, the acidity of thiosulfate in each of the N-4 tanks was measured by means of iodine back titration. In addition, the density of m-hydroxybenzaldehyde in N-4-1 tank was measured by means of an absorptiometric method, and the ratio of the measurement values to those before the continuous processing was defined to be the density of N-4.

With regard to storage stability of the liquids, stabilizing solution in the first tank was stored at DT50° C. for one week in a narrow-mouthed bottle with opening area ratio of 20 $cm^2/l$. Following this, the precipitation in the liquid was evaluated under the following evaluation criteria.

A: No precipitation was observed.

B: Though no precipitation was observed, slight floating substances were noted. There was no perceived problem C: Floating substance and precipitation were observed.

D: Both of precipitation and floating substances apparently occurred.

With regard to the occurrence of staining, Dmin (B) value of Konica Super DD100 was measured after continuous processing. Residue on the reverse side was evaluated under the following criteria by processing Konica Super DD100 after the continuous processing.

A: No residue on the reverse side occurred.

B: Slight residue on the reverse side occurred. However, it is not a problematic.

C: Problematic residue occurred on the reverse side.

D: Residue on the reverse side was apparent.

Procedure (2)

To the above-mentioned granules for replenishing the fixing solution, 30 g of sodium N-myristoyl alanine was mixed for 5 minutes by the use of a mixer in a room wherein conditions were prepared to 25° C. and 45% RH or less. Next, the mixture was tableted at a fill rate of 10 g per tablet by the use of a tableting machine wherein Tough Press Correct 1527HU was produced by Kikusui Seisakusho was modified so that tablets for replenishing fixing for color negative film whose diameter was 30 mm and the thickness was 10 mm was prepared. Incidentally, charging intervals of the replenishing tablets were changed in the following manner.

TABLE 6

| | Embodiment Type | Amount of make-up water (ml/day) | Coefficient k | Density of thiosulfate (g/l) Tank 4-1 | Tank 4-2 | Tank 4-3 | Density of N-4 (%) Tank 4-1 | Storage stability of liquid | Occurrence of stain | Residue on rear | Inside/outside the invention |
|---|---|---|---|---|---|---|---|---|---|---|---|
| 3-1 | 1 | 547 | −0.3 | 9.05 | 0.32 | 0.010 | 60 | C | 0.59 | C | Outside |
| 3-2 | 1 | 517 | −0.2 | 9.60 | 0.36 | 0.014 | 63 | C | 0.59 | C | Outside |
| 3-3 | 1 | 487 | −0.1 | 10.2 | 0.40 | 0.0138 | 67 | B | 0.58 | B | Inside |
| 3-4 | 1 | 457 | 0 | 10.9 | 0.46 | 0.0017 | 72 | B | 0.58 | A | Inside |
| 3-5 | 1 | 427 | 0.1 | 11.8 | 0.52 | 0.021 | 78 | A | 0.58 | A | Inside |
| 3-6 | 1 | 397 | 0.2 | 12.7 | 0.61 | 0.025 | 84 | A | 0.58 | A | Inside |
| 3-7 | 1 | 367 | 0.3 | 13.8 | 0.70 | 0.030 | 92 | B | 0.559 | B | Inside |
| 3-8 | 1 | 337 | 0.4 | 15.2 | 0.084 | 0.039 | 101 | C | 0.61 | C | Outside |
| 3-9 | 1 | 307 | 0.5 | 16.8 | 1.02 | 0.051 | 113 | D | 0.62 | D | Outside |
| 3-10 | 2 | 457 | 0 | 15.7 | 1.05 | 0.065 | 107 | D | 0.62 | D | Outside |
| 3-11 | 2 | 397 | 0.2 | 19.7 | 1.59 | 0.12 | 135 | D | 0.64 | D | Outside |

EXAMPLE 4

An experiment was conducted in the same manner as in Example 3 except that the tablet for replenishing fixing was changed as follows.

3) Tablet for replenishing fixing for color negative film

Procedure (1)

In the same manner as in Procedure (1), 170 g/1530 g of sodium thiosulfate/ammonium thiosulfate, 180 g of sodium sulfite, 20 g of potassium carbonate, 70 g of ethylenediamine tetraacetic acid disodium salt, 20 g of Pine Flow (produced by Matsutani Chemical Co., Ltd.) and 25 g of exemplified compound (10) were crushed in a commercially available bandam mill to an average particle size of 30 μm. This powder was granulated in a stirring granulating machine for about 10 minutes at room temperature by adding 50 ml of water. After granulating, the granulated product was dried in a fluid bed layer drier at 60° C. and 120 minutes so that moisture therein was substantially removed. The particle diameter averaged 800 μm. 50% or more of the particle was set to be within deviation of ±200 through ±250 μm.

TABLE 7

| | Interval of charging a replenishing tablet |
|---|---|
| Tablet for replenishing the color developing solution | One tablet was charged per 8.3 rolls of color negative film (24 EX) |
| Tablet for replenishing the bleaching solution | One tablet was charged per 5.2 rolls of color negative film (24 EX) |
| Tablet for replenishing the fixing solution | One tablet was 10 g. One tablet was charged per 2.4 rolls of color negative film (24 EX) |
| Tablet for replenishing the stabilizing solution | One tablet was charged per 131 rolls of color negative film (24 EX) |

It can be understood that, by the use of a fixing solution wherein compound (10) was added, the effects of the present invention were more apparent.

TABLE 8

| | Embodiment Type | Amount of make-up water (ml/day) | Coefficient k | Density of thiosulfate (g/l) Tank 4-1 | Tank 4-2 | Tank 4-3 | Density of N-4 (%) Tank 4-1 | Storage stability of liquid | Occurrence of stain | Residue on rear surface | Inside/outside the invention |
|---|---|---|---|---|---|---|---|---|---|---|---|
| 4-1 | 1 | 547 | −0.3 | 6.56 | 0.23 | 0.0072 | 60 | C | 0.59 | C | Outside |
| 4-2 | 1 | 517 | −0.2 | 6.96 | 0.26 | 0.0085 | 63 | B | 0.58 | C | Outside |
| 4-3 | 1 | 487 | −0.1 | 7.42 | 0.29 | 0.010 | 67 | B | 0.58 | A | Inside |
| 4-4 | 1 | 457 | 0 | 7.93 | 0.33 | 0.012 | 72 | A | 0.58 | A | Inside |
| 4-5 | 1 | 427 | 0.1 | 8.52 | 0.38 | 0.015 | 78 | A | 0.58 | A | Inside |
| 4-6 | 1 | 397 | 0.2 | 9.21 | 0.44 | 0.018 | 84 | A | 0.58 | A | Inside |
| 4-7 | 1 | 367 | 0.3 | 9.8 | 0.51 | 0.022 | 92 | A | 0.58 | A | Inside |
| 4-8 | 1 | 337 | 0.4 | 15.2 | 0.084 | 0.039 | 101 | B | 0.59 | B | Inside |
| 4-9 | 1 | 307 | 0.5 | 10.8 | 0.61 | 0.028 | 113 | C | 0.60 | C | Outside |
| 4-10 | 2 | 457 | 0 | 12.2 | 0.74 | 0.037 | 107 | C | 0.60 | D | Outside |
| 4-11 | 2 | 397 | 0.2 | 11.4 | 0.76 | 0.047 | 135 | D | 0.61 | D | Outside |

In Example 4, the compensation water amount of the stabilizing solution and the interval of tablet charging were changed as follows. The results were evaluated in the same manner as in Example 4.

TABLE 9

| | Embodiment Type | Amount of fed water (ml/day) | Interval of tablet charging 24 EX/1J | Amonut of make-up water (ml/day) | Coefficient k | Density of thiosulfate (%) Tank 4-1 | Tank 4-2 | Tank 4-3 | Density of N-4 (%) Tank 4-1 | Storage stability of liquid | Occurrence of stain | Residue on rear surface | Inside/outside the invention |
|---|---|---|---|---|---|---|---|---|---|---|---|---|---|
| 5-1 | 1 | 760 | 157 | 507 | −0.2 | 7.9 | 0.33 | 0.012 | 59 | B | 0.59 | C | Outside |
| 5-2 | 1 | 610 | 197 | 497 | −0.2 | 9.2 | 0.44 | 0.018 | 56 | C | 0.59 | D | Outside |
| 5-3 | 1 | 460 | 262 | 487 | −0.2 | 11.0 | 0.61 | 0.028 | 51 | C | 0.60 | D | Outside |
| 5-4 | 1 | 760 | 157 | 432 | 0.1 | 9.6 | 0.47 | 0.012 | 74 | A | 0.58 | A | Inside |
| 5-5 | 1 | 610 | 197 | 437 | 0.1 | 11.0 | 0.61 | 0.028 | 68 | A | 0.58 | B | Inside |
| 5-6 | 1 | 460 | 262 | 442 | 0.1 | 11.8 | 0.82 | 0.042 | 62 | B | 0.59 | B | Inside |
| 5-7 | 1 | 760 | 157 | 300 | 0.1 | 14.4 | 1.19 | 0.09 | 109 | C | 0.62 | C | Outside |
| 5-8 | 2 | 610 | 197 | 305 | 0.1 | 18.1 | 1.89 | 0.18 | 113 | C | 0.64 | C | Outside |
| 5-9 | 2 | 460 | 262 | 310 | 0.1 | 24.7 | 3.39 | 0.40 | 119 | C | 0.66 | C | Outside |

Even when the amount of compensation water was reduced and the amount of tablet charging was reduced, in the case that evaporation water was replenished at the final-process tank of the present invention collectively and coefficient k is within the range of the present invention, it can be understood that desirable effects are shown.

Owing to the present invention, a stable automatic processing machine wherein the amount of replenishing solution is less and thereby the amount of effluent is substantially zero, structure of equipment is simple and maintenance is easily conducted.

In addition, a processing method wherein influence from the mixing of the processing solution in the previous step is less and there is no staining on the processed light-sensitive material and residue on the reverse side, even though it is a processing method employing an automatic processing machine with low replenishing amount.

What is claimed is:

1. An apparatus for processing a light-sensitive material, comprising:

a plurality of processing tanks serially arranged along a conveyance passage on which the light-sensitive material is conveyed in a conveying direction, means for replenishing compensation water into a most-downstream tank arranged most downstream among the plurality of processing tanks in terms of the conveying direction under the following inequality:

$$0 \leqq (E-C)/(P-R) < 0.3$$

E (ml/day): amount of evaporated water from the plurality of processing tanks per day, wherein the amount of evaporated water is total amount of amount of evaporated water from the series of tanks when the temperature control is conducted for 10 hours under the ambient condition that temperature is 25° C. and relative humidity is 50% and amount of evaporated water when the temperature control is not conducted for 14 hours under the above ambient condition, C (ml/day): amount of the compensation water to compensate the evaporated water from the plurality of processing tank per day, P ($m^2$/day): amount of the light-sensitive material processed per day, R (ml/$m^2$): amount of replenishing processing solution per $m^2$ of light-sensitive material; and means for shifting a processing solution from the most downstream tank to upstream tanks sequentially in the reverse direction to the conveying direction by the solution-shifting means.

2. The apparatus of claim 1, wherein the shifting means is an overflow construction in which the processing solution overflows from a downstream tank to a upstream tank in the plurality of processing tanks.

3. The apparatus of claim 2, wherein the upstream and downstream tanks are stabilizing tanks.

4. The apparatus of claim 1, wherein the solution-shifting means is a pump by which the processing solution is shifted from a downstream tank to a upstream tank.

5. The apparatus of claim 4, wherein the processing solution in amount necessary to compensate evaporated amount from the upstream tank is shifted to the upstream tank.

6. The apparatus of claim 4, wherein the upstream tank is a fixing tank or a bleaching fixing tank and the downstream tank is a stabilizing tank.

7. The apparatus of claim 1, wherein one of the plurality of processing tank comprises a processing solution containing a composition represented by Formula 1:

Formula [1]

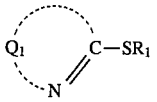

wherein $Q_1$ represents an atom group necessary to form a nitrogen-containing heterocycle (including those wherein a 5- to 6-membered unsaturated ring is condensed); $R_1$ represents a hydrogen atom, an alkaline metal atom,

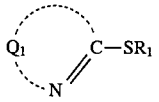

or an alkyl group; and Q" is defined as being identical to $Q_1$.

8. The apparatus of claim 1, wherein the processing solution is replenished by separately supplying solid processing agent and water directly into the processing tank in accordance with the amount of the processed light-sensitive material.

9. The apparatus of claim 8, wherein said solid processing agent and said water are supplied in the most downstream tank.

* * * * *